United States Patent [19]

Katayama et al.

[11] Patent Number: 4,830,877

[45] Date of Patent: May 16, 1989

[54] COMPOSITIONS FOR FORMING INSULATING FILMS ON ELECTROMAGNETIC STEEL PLATES AND METHODS FOR MAKING THE SAME

[75] Inventors: Kiichiro Katayama; Yasuharu Meada; Koji Wakabayashi; Toshinori Murakami, all of Ichikawa, Japan

[73] Assignee: Nisshin Steel Co., Ltd., Tokyo, Japan

[21] Appl. No.: 116,901

[22] Filed: Nov. 5, 1987

[51] Int. Cl.[4] ..... B05D 5/12

[52] U.S. Cl. ..... 427/127; 148/251; 148/245; 252/623 V; 427/388.4

[58] Field of Search ..... 427/388.4, 127; 252/62.3 V; 148/6.16, 6.2

[56] References Cited

U.S. PATENT DOCUMENTS

| | | | |
|---|---|---|---|
| 2,902,390 | 9/1959 | Bell | 427/388.4 |
| 3,061,563 | 10/1962 | Zdanowski et al. | 427/388.4 |
| 3,793,073 | 2/1974 | Kitayama et al. | 148/6.15 R |
| 3,873,349 | 3/1975 | Kimura et al. | 427/36 |
| 4,032,675 | 6/1977 | Irie et al. . | |
| 4,253,886 | 3/1981 | Aonuma et al. | 427/127 |
| 4,618,377 | 10/1986 | Nakamura et al. . | |

FOREIGN PATENT DOCUMENTS

| | | | |
|---|---|---|---|
| 1521907 | 5/1966 | Fed. Rep. of Germany | 427/388.4 |
| 62-102864 | 5/1987 | Japan . | |
| 62-100561 | 5/1987 | Japan . | |

*Primary Examiner*—Janyce Bell

*Attorney, Agent, or Firm*—Fleit, Jacobson, Cohn & Price

[57] ABSTRACT

The present invention provides an insulating film-forming composition in which a mixed resinous liquid obtained from a specific proportion of an aqueous emulsion of an acrylic resin and/or an acryl-styrene base resin and an aqueous dispersion of PAN free substantially from any emulsifier/dispersant is added to and mixed with an inorganic film-forming composition containing as the main component a chromate or a chromate plus a phosphate, which has conventionally been used in the prior art, in a specific proportion, and a method for forming an insulating film by coating and drying such a composition on an electromagnetic steel plate. A substantial portion of the starting materials can be commerically available products. With the composition, provided to have a longer pot life, and method of the present invention, an efficient coating can be carried out, while suppressing foaming to a consideraly low level, thereby obtaining an insulating film excelling in insulating properties and other film properties.

5 Claims, 2 Drawing Sheets

COMPOSITIONS FOR FORMING INSULATING FILMS ON ELECTROMAGNETIC STEEL PLATES AND METHODS FOR MAKING THE SAME

BACKGROUND OF THE INVENTION

1. Field of the Invention

The present invention relates to a composition for forming an insulating film on an electromagnetic steel plate, which can be applied on such a steel plate as can reduced or limit foaming thereon but having improved workability, and further excels in film properties as represented in terms of insulating properties, punchability and space factor, and to a method for making the same.

2. Statement of the Prior Art

In the prior art, a number of techniques have been proposed in relation to the methods for forming insulating films on the surfaces of electromagnetic steel plates or the compositions for forming such insulating films. According to the prior art, inorganic films are primarily formed using the compositions for forming insulating films (hereinafter often referred to as the film or films), which are composed mainly of chromates or phosphates or a combination thereof and, in some efforts, the film properties of the films have been improved by various methods involving the addition of metal oxides such as MgO, ZnO and CaO etc. or whatever which enhance their insulating properties by reacting with free acids present in the film-forming compositions, the addition of small quantities of glycerin or saccharides for promoting the aforesaid reactins and forming oxides insoluble in water, organic solvents or whatever, and the addition of boric acid, water glass, condensed phosphates, silica or whatever. In the present disclosure, the aqueous solutions of the inorganic film-formable substances composed mainly of chromates or phosphates, as mentioned above, may hereinafter be called the inorganic film-forming composition(s). However, the inorganic films, a most part of which is occupied and consituted by such inorganics, have had the disadvantages that they are poor in punchability and adhesiveness during processing, although they have been found to excel in insulating properties.

In recent years, increased weight has been placed on the punchability of electromagnetic steel plates. Methods attempted from this point-of-view have included the formation of organic films on the aforesaid inorganic films and the application of the film-forming composition containing a mixture of an inorganic film-forming element (hereinafter may be referred to as the inroganic component) with an organic film-formable resin (which may hereinafter be called either as the organic component or simply as the resin), thereby forming an inorganic/organic combination film.

However, the former method should be carried out in a two coating processes, and is unavoidably rather costly.

In order to carry out the latter method, a mixed liquid is prepared by mixing the inorganic film-forming composition containing as the inorganic component a chromate or phosphate showing a strong oxidative effect with an aqueous emulsion in which the organic film-formable resin is emulsified and dispersed, and is used. However, this method has the following disadvantages.

First, the pot life is short. In other words, the emulsified dispersion of the resin is no unstable that the mixed liquid is gelled due to the agglomeration of the resin for several hours after mixing, and is often unusable for ordinary coating.

Second, since the mixed liquid contains an emulsifier or dispersant used for the preparation of the aqueous solution of the resin, it is foamed or subjected to increased viscosity when stirred during coating due to circulation by a pump, supply operation, rotation of the roll of a roll coater and the like, thus making it impossible to form a satisfactory film. Especially when foaming takes place, there are found crateriform pin holes or foamy defects in the resulting film, which not only give rise to a drop in corrosion resistance, but also lead to poor insulating performance, thus rendering it impossible to obtain a uniform and satisfactory film.

SUMMARY OF THE INVENTION

An object of the present invention is to solve the aforesaid problems by the provision of a composition for forming an insulating film, which can minimize foaming during coating, and provide a film that is thin and has excellent film properties, and a method for forming such an insulating film.

According to the first aspect of the present invention, there is provided a composition for forming an insulating film on an electromagnetic steel plate in which:

an aqueous emulsion of pH 2 to 8, in which an organic film-formable resin consisting of an acrylic resin and/or a acryl-styrene base resin is emulsified and dispersed, is mixed with an aqueous dispersion of pH 6 to 8, which is substantially free from any emulsifier/dispersant and in which an acrylonitrile base resin is dispersed, in such a manner that the unvolatile matter contained in the latter amounts to 10 to 90% by weight of the total quantity of the unvolatile matters contained in both, thereby obtaining a mixed resinous liquid, and the thus liquid is added to and mixed with an aqueous solution of an inorganic film-formable substance composed mainly of a chromate in such a manner that the unvolatile matters contained in said mixed resinous liquid amount to 15 to 120 parts by weight relative to 100 parts by weight, calculated as $CrO_3$, of the chromate contained in said aqueous solution.

According to the second aspect of the present invention, there is provided a composition for forming an insulating film on an electromagnetic steel plate in which:

an aqueous emulsion of pH 2 to 8 in which an organic film-formable resin consisting of an acrylic resin and/or a acryl-styrene base resin is emulsified and dispersed is mixed with an aqueous dispersion of pH 6 to 8, which is substantially free from any emulsifier/dispersant and in wich an acrylonitrile base resin is dispersed, in such a manner that the unvolatile matter contained in the latter amounts to 10 to 90% by weight of the total quantity of the unvolatile matters contained in both, thereby obtaining a mixed resinous liquid, and the thus mixed resinous liquid is added to and mixed with an aqueous solution of an inorganic film-formable substance composed mainly of a chromate and a phosphate in such a manner that the unvolatile matters contained in said mixed resinous liquid amount to 15 to 120 parts by weight relative to 100 parts by weight, calculated as $CrO_3$ and $H_3PO_4$, of the chromate and phosphate contained in said aqueous solution.

According to the third aspect of the present invention, there is provided a method for coating the composition according to the 1st or 2nd aspect of the present invention on an electromagnetic steel plate and heating it at 300° C. to 500° C. into an insulating film in the range of 0.4 to 2.0 g/m$^2$.

BRIEF DESCRIPTION OF THE DRAWINGS

The aforesaid and other objects and features of the present invention will become apparent from the following detailed description with reference to the accompanying drawings, which are given for the purpose of illustration alone, and in which.

DETAILED DESCRIPTION OF THE INVENTION

Figure 1:
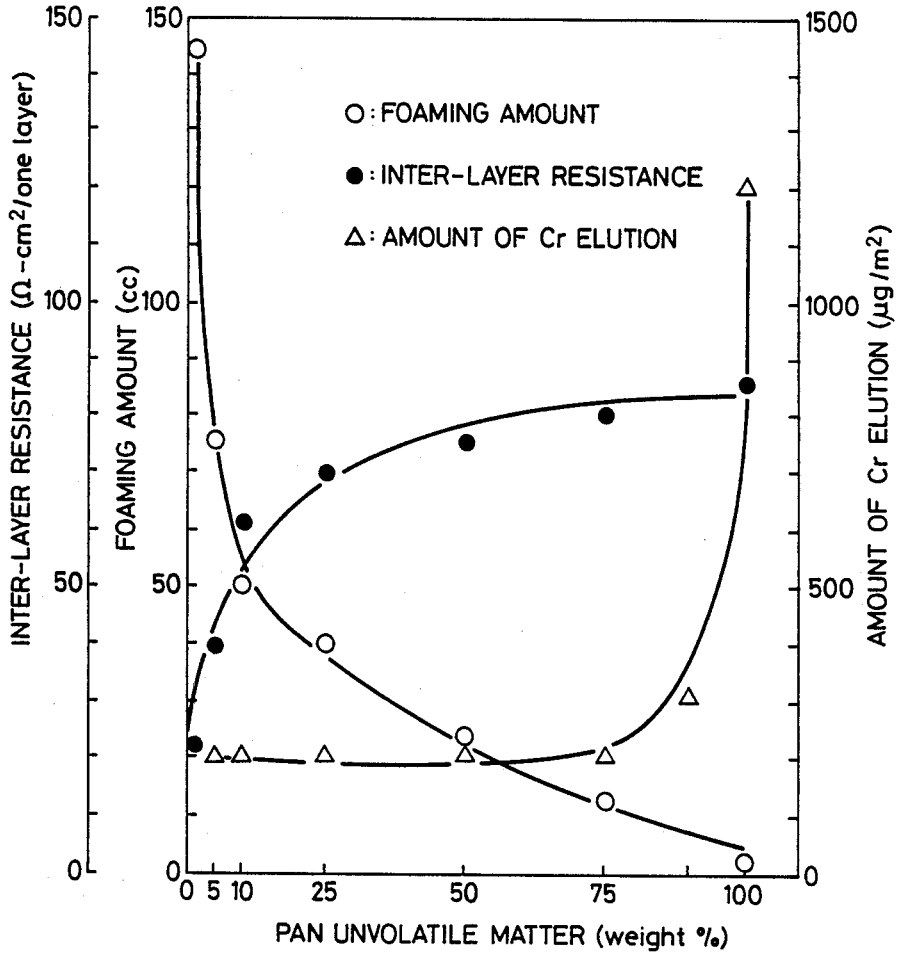
FIGS. 1 and 2 are graphical views illustrating the proper proportion of the aqueous emulsions of the organic film-formable resins with respect to the the aqueous dispersions of acrylonitrile resins, when preparing the mixed resinous liquids according to the first and second aspects of the present invention.
Figure 2:
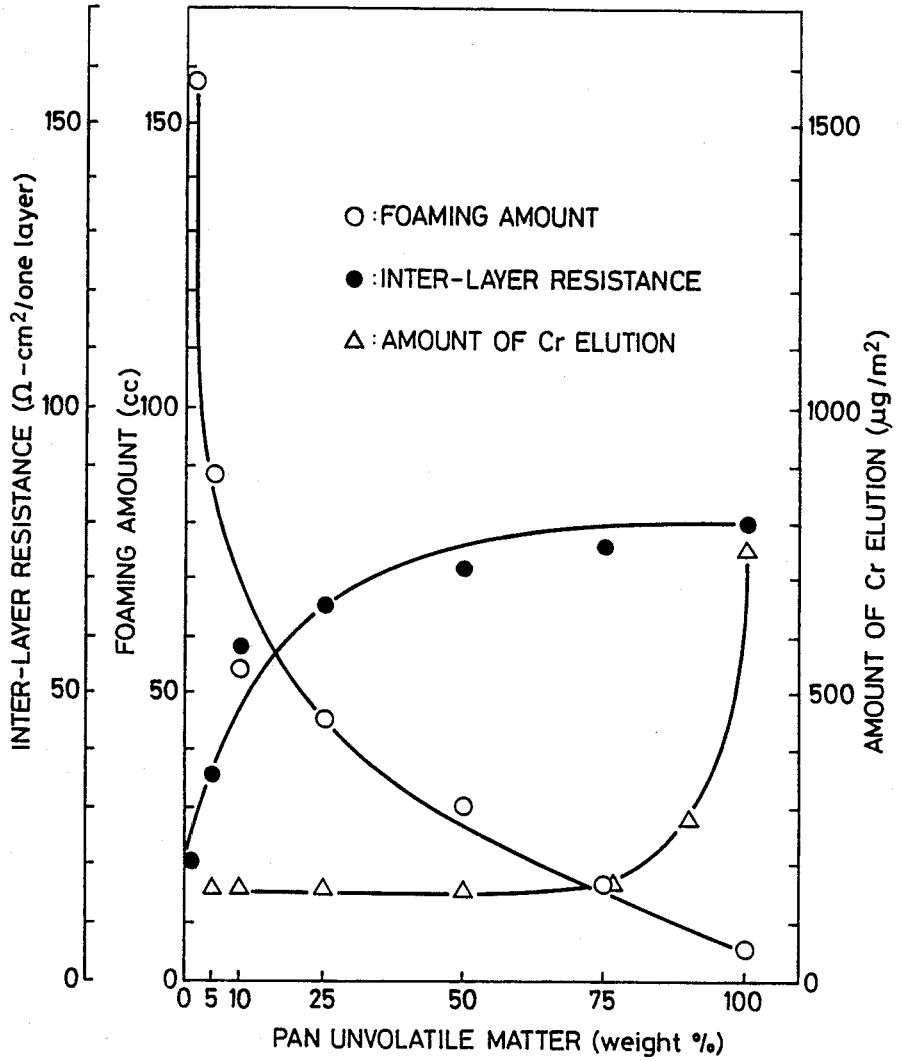

In view of improvements in the pot life of the film-forming compositions, of the primary importance considered is that the conventional inorganic film-forming composition showing a strong oxidative effect and containing as the main component a chromate with or without a phosphate shows compatibility with respect to the aqueous emulsion of the organic film-formable resin added thereto and mixed therewith, and that the mixed liquid thereof can be kept in a stably emulsified and dispersed state, while containing the chromate (and the phosphate) showing a strong oxidative effect but without decomposing the aforesaid resin present as the emulsion particles.

The conventional inorganic film-forming compositions composed mainly of a chromate include an aqueous solution disclosed in Japanese Patent Publication No. 32(1957)-9555 (obtained by adding 1 to 4% by weight of glycerin and 2 to 5% by weight of boric acid to a 10 to 60 weight % aqueous solution of zinc chromate and having the composition expressed in terms of $CrO_3$—ZnO—$H_3BO_3$—glycerin) or an aqueous solution obtained by substituting MgO and CaO for ZnO in the aforesaid composition, which show similar chemical properties and react with free chromic acid, both being usually in the pH range of 5.0 to 5.7. By way of concrete example, mentioned are an aqueous solution of pH 5.2 containing $CrO_3$, MgO, $H_3BO_3$ and glycerin in the respective concentrations of 150 g/l, 30 g/l, 50 g/l and 30 g/l (hereinafter sometimes referred to as Concrete Example 1) and an aqueous solution of pH 5.7 containing $CrO_3$, MgO, $H_3BO_3$ and glycerin in the respective concentrations of 150 g/l, 50 g/l and 30 g/l (hereinafter sometimes called Concrete Example 2).

The conventional inorganic film-forming compositions composed mainly of a chromate and a phosphate include aqueous solutions having the composition described in Japanese Patent Publication No. 38(1963)-20707, i.e., those obtained by adding water glass and 10% and less by weight of one or more selected from magnesium oxide, calcium oxide, zinc oxide and anhydrous silicic acid to aqueous solutions containing 5 to 40% by weight of phosphoric acid, 1 to 10% by weight of a compound containing sexivalent chromium such as chromic anhydride and dichromic acid and 8% and less by weight of boric acid or a borate and being usually in the ph range of 4.0 to 5.7. By way of concrete example, mentioned are an aqueous solution of pH 4.1 containing $CrO_3$, $H_3PO_4$, MgO, $H_3BO_3$ and glycerin in the respective concentrations of 90 g/l, 60 g/l, 30 g/l, 30 g/l and 30 g/l (hereinafter sometimes called Concrete Example 3), or an aqueous solution of pH 5.3 containing $CrO_3$, $H_3PO_4$, MgO, $H_3BO_3$ and glycerin in the respective concentrations of 100 g/l, 50 g/l, 35 g/l, 40 g/l and 30 g/l (hereinafter sometimes called Concrete Example 4).

Testing was carried out as regards the compatibility and stability of the mixtures obtained by adding and mixing aqueous solutions of various organic film-formable resins to and with such conventional inorganic film-forming compositions.

As a result, it has been found that both an aqueous emulsion of pH 2 to 8 and an acrylic resin—for instance, an aqueous emulsion of pH 2.4 and having an unvolatile content of 30% by weight, in which polymethacrylate is emulsified and dispersed in a concentration of 150 g/l and which may be referred to as Concrete Example 5—and an aqueous emulsion of pH 2 to 8 and an acrylstyrene base resin—for example, an aqueous emulsion of pH 7.8 and having an unvolatile content of 35% by weight, in which a methylmethacrylate/styrene copolymer is emulsified and dispersed in a concentration of 150 g/l (which may hereinafter be call Concrete Example 6) show compatibility with respect to the aforesaid inorganic film-forming compositions, and that the mixed liquids thereof do not at all undergo any gelation and viscosity change due to the decomposition and agglomeration of the resins, even after they have been allowed to stand alone at normal temperature for one month.

However, it has been found that the mixed liquids obtained by mere mixing of such inorganic film-forming compositions composed mainly of a chromate or a chromate/phosphate combination with the aqueous emulsions of the organic film-formable resins are subjected to considerable foaming during coating in situ. In some efforts, various defoamers and surfactants were added to the mixed liquids. However, it has been noted that, although temporarily effective, they do not only lose their defoaming effect while continuously used over an extended period of time, but also have an adverse influence upon the insulating properties of the films.

On the other hand, in the course of studies made of aqueous emulsions of various organic film-formable resins, aqueous dispersions which are based on acrylonitrile resins (hereinafter simply referred to as PAN), and are substantially free from any emulsifier/dispersant, have been found to be very effective for the suppression of foaming.

In a number of experiments made with a view to allowing the film-forming compositions to be continuously deposited on electromagnetic steel plates over an extended period without foaming, making use of the effect of PAN upon the suppression of foaming, mixed resinous liquids obtained by mixing the aqueous emulsions of said organic film-formable resins with the liquid PAN dispersions not substantially containing any emulsifier/dispersant were added to and mixed with the inorganic film-forming compositions composed mainly of chromates with or without phosphates to prepare film-forming compositions, which were in turn coated and dried on electromagnetic steel plates to form coated films. Then, detailed examinations were made of the relationships between proportions of the resins in said mixed resinous liquids and amount of foaming of the film-forming compositions or film properties of the resulting films.

In consequence, it has been found that the incorporation and use of the aqueous dispersions of PAN reduces or limits foaming to such an extremely high extent that much more improved coating is achieved, and that, when the mixed resinous liquids containing a certain range of PAN are used, the obtained films show much more excellent film properties.

First of all, investigations were made of the proper range of proportions of the aqueous emulsions of the organic film-formable resins with respect to the aqueous dispersions of PAN, when preparing the mixed resinous liquids.

It is here to be noted that, if the aqueous solutions of the inorganic film-formable materials used contain a chromate and a phosphate as the main components, the quantitative ratio of the chromate to the phosphate should then be within the range of 2:1 to 1:1, when calculated as $CrO_3$ and $H_3PO_4$, respectively.

It is also to be noted that the term "acrylic resin" used in this disclosure refers to acrylic resins, except for acrylonitrile base resins, which form stable emulsions in acidic aqueous solutions. For instance, TOUGHTIC $G_2$ (Trade Name) manufactured by Nippon Exelan K. K. is exemplified.

It is further to be noted that the term "acryl-styrene base resin" means resins which form stable acryl-styrene base resin emulsions in acidic aqueous solutions. POLYTRON F-2000 (Trade Name) manufactured by Asahi Kasei K. K. is exemplified by way of example.

Still further, it is to be noted that by the term "acrylonitrile base resin (PAN)", is meant a homopolymer or copolymer comprising at least 90 weight % of acrylonitrile with the balance, if present, being an ethylenically unsaturated compound. TOUGHTIC F 120 (Trade Name) manufactured by Nippon Exelan K. K. is exemplified by way of example.

The aforesaid investigations were made in the following manner.

Using PAN having an acrylonitrile component content of 90 weight % and a particle size of up to 0.5 microns, was prepared an aqueous dispersion of pH 7.1, having an unvolatile content of 27 weight %.

On the other hand, the already exemplified Concrete Example 6, which was an aqueous emulsion of the acryl-styrene base resin, was used as the aqueous emulsion of the organic film-formable resin. This aqueous emulsion was mixed with the aforesaid aqueous dispersion of PAN in such a manner that the latter contained varied amounts, say, 0 to 100 weight % of unvolatile matter (which may hereinafter be referred to as the PAN unvolatile matter) with respect to the combined amount of unvolatile matters contained in both, thereby preparing different mixed resinous liquids.

These mixed resinous liquids were added to the already exemplified Concrete Example 1, viz., the inorganic film-forming composition containing a chromate as the main component in such a manner that the ratio of the amount of the chromate, as calculated as $CrO_3$, contained in the latter with respect to the combined unvolatile matters contained in the former was expressed in terms of 100 parts by weight: 100 parts by weight, to thereby obtain different film-forming compositions having different PAN contents.

Similarly, these mixed resinous liquids were added to the already exemplified Concrete Example 3, viz., the inorganic film-forming composition containing a chromate and a phosphate as the main components in such a manner that the ratio of the amounts of the chromate and phosphate, as calculated as $CrO_3$ and $H_3PO_4$, contained in the latter with respect to the combined unvolatile matters contained in the former was expressed in terms of 100 parts by weight: 100 parts by weight, to thereby obtain different film-forming compositions having different PAN contents.

These film-forming compositions were first measured for their amount of foaming. Then, they were coated in situ on electromagnetic steel plates (at a line speed of 60 to 150 m/min. in natural or reverse coating fashion) to observe the state of foaming and to measure the film properties of the films coated thereon. It is understood that coating was carried out in such a manner that the film amount reached a certain value of 1 $g/m^2 \pm 0.02$ after coating, and drying was done under certain conditions at 350° C. for 2.5 minutes.

The accompanying drawings each show the relationship between the weight percentage of the PAN unvolatile matter with respect to the total unvolatile matters contained in the mixed resinous liquids used for the respective film-forming compositions and the amount of foaming of such compositions together with the film properties as represented in terms of the relationship between the inter-layer resistance ($\Omega$-$cm^2$/one layer) of the coated electromagnetic steel plates and the amount of chromium elution ($\mu g/m^2$). For the measuring procedures, refer to the examples given later.

As can clearly be seen from the drawings, the amount of foaming of each film-forming composition decreases considerably with an increase in the PAN unvolatile matter contained therein, that is, an increase in the PAN content. More specifically, when the PAN unvolatile matter is contained in the combined unvolatile matters of each mixed resinous liquid in an amount of 5 weight %, the amount of foaming is reduced twice as much as the case (which may hereinafter be referred to as the blank) where the content of the PAN unvolatile matter is zero weight %; in other words, only the aqueous emulsion of the aforesaid acryl-styrene base resin is used in lieu of the mixed resinous liquid. With the PAN unvolatile matter content being 10 weight %, the amount of foaming is reduced to about one-third. Any foaming is not substantially observed, however, when the PAN unvolatile content is 100 weight %; in other words, only the aqueous dispersion of PAN is substituted for the mixed resinous liquid. From the results of coating tests performed in situ, on the other hand, any coating defect due to foaming was hardly observed at a PAN unvolatile matter content equal to or higher than 10 weight %.

Referring to the inter-layer resistance that is one important film property, it is increased to about one-point-eight- or two- and three-times as much as the blank, when the PAN unvolatile matter content with respect to the combined unvolatile matters contained in the mixed resinous liquid used is 5 weight % and 10 weight %, respectively, as shown in the drawings. In the following disclosure, when the amount or content of the PAN unvolatile matter is referred to, the wording "with respect to the total or combined unvolatile matters contained in the mixed resinous liquid or liquids" may be omitted for short.

The results of testing for measuring the resistance to chromium elution that is another film property (two-hour immersion in boiling water) indicate that the amount of Cr elution remains substantially constant over a considerable range, even when the content of the PAN unvolatile matter increases from zero weight %, but sharp Cr elution is found to take place at around 90 weight %, as appreciated from the drawings. Although no clear explanation is still made to this cause, it fairly appears that, as micrographical observation of the surface of the film obtained with the mixed resin having a PAN unvolatile matter content of 95 weight % indicates the clear presence of PAN particles, such sharp Cr elution is attributable to a decrease in the binder action of the organic film-formable resin filled in between the PAN particles, which is associated with a decrease in the amount thereof.

From the foregoing results, the content of the PAN unvolatile matter with respect to the total unvolatile matters contained in the mixed resin should properly be within the range of 10 to 90 weight %. Such incorporation of PAN into the film-forming compositions has then been recognized to result in noticeable improvements in the state of coating. Similar results were obtained from similar experiments performed using the aqueous emulsion of the acrylic resin (the aforesaid Concrete Example 5) without or with that of the acryl-styrene base resin). Further experiments has confirmed that such an effect as mentioned above is obtained, even when the proportion of the inorganic film-forming compositions containing as the main component a chromate without or with a phosphate is varied, unless it departs from a certain range.

Further investigations were made of the relationship between the proportion of the inorganic film-forming compositions with respect to the mixed resinous liquids, which is closely correlated with the quantitative ratio of the inorganic and organic components in the film-forming compositions, and the thickness or properties of the resulting films.

In general and for use, the resinous concentration of the aqueous emulsions of the organic film-formable resins are preferably expressed in terms of an unvolatile matter concentration of 20 to 50 weight %. Commercially available aqueous emulsions have a resinous concentration of 25 to 40 weight % for the acrylic resins and 35 to 50 weight % for the acryl-styrene base resins, and commercially available aqueous PAN dispersions have a resinous concentration of 20 to 30 weight %. Prepared from these resinous emulsions or dispersions were mixed resinous liquids based on the acrylic resin-PAN system (in which the aforesaid TOUGHTIC $G_2$ and TOUGHTIC F 120 were used) and the acryl-styrene resin-PAN system (in which the aforesaid POLYTRON F-2000 and TOUGHTIC F 120 were used) in such a manner that the PAN unvolatile matter amounted to 75 weight % of the combined unvolatile matters contained therein. Either one of these liquids was added to and mixed with the inorganic film-forming composition containing a chromate as the main component (i.e., the aforesaid Concrete Example 1) in such a manner that the combined unvolatile matters contained in the former occupied various parts by weight with respect to 100 parts by weight of the chromate, as calculated as $CrO_3$, contained in the latter, thereby obtained film-forming compositions, which were in turn coated on elelctromagnetic steel plates by means of roll coating for the purpose of testing. Similar tests were carried out using the inorganic film-forming composition containing a chromate and a phosphate as the main componenst (i.e., the aforesaid Concrete Example 3).

In consequence, it has been found that the combined unvolatile content of the mixed resinous liquids should be at least 10 parts by weight, preferably at least 15 parts by weight with respect to a total of 100 parts by weight of the chromate or the chromate plus the phosphate as calculated as $CrO_3$ or $CrO_3+H_3PO_4$, since, when it is in a range of 5 to 6 parts by weight, any uniform coating is often unachieved by roll coating due to poor pickup property.

It has also been found that preferred results are obtained for the punchability and corrosion resistance of the film properties, when the unvolatile content of the mixed resinous liquids is at least 10 parts by weight with respect to the amount of the chromate or the chromate plus the phosphate, calculated as $CrO_3$ or $CrO_3+H_3PO_4$. Taken altogether, the lower limit of the proportion of the mixed resinous liquids added to the inorganic film-forming compositions containing a chromate without or with a phosphate as the main component (hereinafter simply described as the proportion of the mixed resinous liquid or liquids) should be 15 parts by weight, as expressed in terms of the parts by weight of the combined unvolatile content of the latter with respect to 100 parts by weight of the former, calculated as $CrO_3$ or $CrO_3+H_3PO_4$.

The upper limit of the proportion of the mixed resinous liquids should be 120 parts by weight for the following reasons which were made clear as a result of investigations. This is to say, a large amount of the organic components contained in the film-forming compositions is very effective for punchability and coating properties. However, too large an organic component content is found to deteriorate TIG weldability that is closely correlated with the properties of insulating films.

The upper and lower limits of the film amount, obtained when coating the thus obtained insulating film-forming compositions on electromagnetic steel plates, should be determined for the following reasons. It is a matter of course that the more the film amount, the higher the insulating and anticorrosion effects will be. However, since it is required to reduce the film amount in view of processability, space factors (which should preferably be reduced as much for miniaturization of equipment or apparatus as possible), economical consideration and other factors, it is preferred that satisfactory insulating properties and corrosion resistance are assured with reduced or limited film amounts. As already mentioned, if the PAN content of the mixed resinous liquids is 10 to 90% by weight as expressed in terms of the weight percentage of the combined unvolatile matters contained in the mixed resinous liquids, when the resulting film has an inter-layer resistance three times or more than that of the film containing no PAN. In view of the aforesaid and other considerations, the lower limit of the film amount need be 0.4 $g/m^2$, since it assures an inter-layer resistance of at least 20 $\Omega$-$cm^2$/one layer that practically offers no problem, and keeps other properties at a satisfactory level. On the other hand, the allowable upper limit of the film amount should be 2.0 $g/m^2$ in view of TIG weldability, space factor, economical consideration and whatever.

The film-forming compositions may be coated to the aforesaid film amounts on electromagnetic steel plates by a roll coater or other suitable means. Thereafter, heating and drying of 300° to 500° C. is applied to obtain insulating films. A relatively short heating period of time, usually 0.5 to 3 minutes should be adequate.

EXAMPLES AND COMPARISON EXAMPLES

The present invention will now be explained in further detail with reference to the following examples and comparison examples.

EXAMPLES A1-9 and Comparison Examples A1-5

Various film-forming compositions were prepared in accordance with the compositions specified in Table 1. The starting materials used were as follows. The already exemplified Concrete Examples 1 and 2 were used as the aqueous solutions of the inorganic film-forming substances containing the chromate as the main component, the already exemplified Concrete Examples 5 and 6 as the aqueous emulsions of the acrylic resin and acryl-styrene base resin, and the same aqueous dispersion of PAN as used in the experiments already illustrated with reference to FIG. 1 as the dispersion in which PAN was dispersed and no emulsifier/dispersant was contained. In Table 1, marks AE, AS and PAN stand for the unvolatile contents in parts by weight of the aqueous emulsion of the acrylic resin, the aqueous emulsion of the acryl-styrene base resin and the aqueous dispersion of PAN, respectively.

The thus prepared film-forming compositions were reverse-coated on electromgnetic steel plates by roll coating, and were then dried and fixed thereto by heating to an atmospheric temperature of 350° C. for 2.5 minutes in a hot-air drying type oven. The film amounts were regulated by regulating the roll coating conditions such as the peripheral speed of the coater roll, the condition for the engagement of the applicator roll with the back-up roll and the concentration of the film-forming compositions.

The aforesaid properties were estimated in the following manners.

FOAMABILITY

One hundred cc of each composition was put into a measuring cylinder of (250 cc) which was in turn shaken and allowed to stand alone for 2 minutes. Then, the foam height was measured for the estimation of foamability.

⊙: Foaming Amount=0 to 10 cc
○: Foaming Amount=10 to 50 cc
Δ: Foaming Amount=50 to 100 cc
X: Foaming Amount≧100 cc

STORAGE STABILITY

Each composition was allowed to stand alone in a room kept at temperatures of 20°±2° C. and 65°±5° C. for one month to estimate its storage stability in terms of the viscosity and discoloration of the coating composition as well as the presence of precipitates.

COATING PROPERTIES

Each composition was reverse-coated on an electromagnetic steel plate at a line speed of 60 to 150 m/mm to estimate the appearance of the finished coating.

○: Satisfactory
Δ: Some defects due to foaming occurred.
X: Marked defects due to foaming occurred.

FILM AMOUNT

This was measured by the method in which an electromagnetic steel plate (hereinafter called the test piece) formed thereon with the film after drying and fixation was immersed in a 50% aqueous solution of NaOH for dissolution and the fluorescent X-ray method.

ADHESIVE PROPERTIES

A round rod of 5 mm in radius was wound around the test piece to observe the release of the film under a 10-X loupe.

⊙: No release of the film occurred.
○: Some release of the film occurred.
X: Marked release of the film occurred.

CORROSION RESISTANCE

After saline water was sprayed to the test piece for 7 hours according to JIS Z 2371, the occurrence of red rust thereon was observed.

⊙: Any red rust did not occur at all.
○: An area of occurrrence of red rust was 5% or smaller.
Δ: An area of occurrence of red rust was 5 to 10%.
X: An area of occurrence of red rust was 10% or larger.

CHROMIUM ELUTION

After the test piece was immersed in boiling water for 2 hours, Cr in the boiling water was measured by atomic-absorption spectorscopy.

INTER-LAYER RESISTANCE

This was measured in accordance with JIS C 2550.

HEAT RESISTANCE

After the test piece was annealed at 750° C. for 2 hours in a nitrogen atmosphere, the occurrence of sticking was measured for the estimation of heat resistance.

○: No sticking occurred.
Δ: Some sticking occurred.
X: Marked sticking occurred.

PUNCHABILITY

This was measured in terms of the maximum number of punchings at which the height of warpage of the punched sample was no higher than 50 micornmeters, when punching was carried out under the following conditions.

Number of Strokes: 500 strokes/min.
Mold Material: SKD 11
Punching Diameter: 5 mm in diameter
Punching Oil: Light Oil
Press Machine: High-Speed Automatic Machine manufactured by Mitsui Seiki Co., Ltd.

WELADABILITY

Under the following conditions:
Welding Current: 120 A
Electrode Diameter: 2.4 mm ϕ
Core Pressure: 100 kg/cm$^2$
Welding Speed: 60 cm/min.
Welding Machine: TIG Welding Machine manufactured by Osaka Henatsuki Co., Ltd.

each sample was TIG welded to observe the occurrence of blow holes for the estimation of weldability.

○: No blow hole was found.
Δ: Slight blow holes were found
X: Marked blow holes were found.

The obtained results are set forth in Table 1.

TABLE 1

| | | Composition of Insulating Film-Forming Composition | | | | | | Estimation of Properties | | |
|---|---|---|---|---|---|---|---|---|---|---|
| | | Inorganic Film-Forming Composition | Composition of Mixed Resinous Liquid [AE] | [AS] | [PAN] | Weight % of [PAN] Note 1 | Combined Unvolatile Matter of Mixed Resinous Liquid (weight parts)Note 2 | Properties of Composition: Foamability | Storage Stability | Coating Properties |
| Examples | A1 | (Concrete Example 1) | 3 | — | 15 | 83 | 120 | ◎ | No Change | ○ |
| | 2 | (Concrete Example 1) | 2 | 1 | 8 | 73 | 73 | ○ | No Change | ○ |
| | 3 | (Concrete Example 1) | 15 | — | 3 | 17 | 120 | ○ | No Change | ○ |
| | 4 | (Concrete Example 1) | — | 2 | 1 | 33 | 20 | ○ | No Change | ○ |
| | 5 | (Concrete Example 2) | 2 | — | 15 | 88 | 113 | ◎ | No Change | ○ |
| | 6 | (Concrete Example 2) | — | 4 | 10 | 71 | 93 | ○ | No Change | ○ |
| | 7 | (Concrete Example 2) | 1 | — | 2 | 67 | 20 | ○ | No Change | ○ |
| | 8 | (Concrete Example 2) | 1 | 1 | 10 | 83 | 80 | ◎ | No Change | ○ |
| | 9 | (Concrete Example 2) | 1 | 1 | 1 | 33 | 20 | ○ | No Change | ○ |
| Comparison Examples | A1 | (Concrete (Example 1) | — | — | 15 | 100 | 100 | ◎ | No Change | ○ |
| | 2 | (Concrete Example 1) | 10 | — | 0.5 | 5 | 70 | X | No Change | X |
| | 3 | (Concrete Example 1) | 5 | — | 15 | 75 | 133 | ○ | No Change | ○ |
| | 4 | (Concrete Example 2) | 10 | 5 | — | 0 | 100 | X | No Change | X |
| | 5 | (Concrete Example 2) | 1 | — | 1 | 50 | 13 | ○ | No Change | Δ |

| | | Estimation of Properties Film Properties | | | | | | | |
|---|---|---|---|---|---|---|---|---|---|
| | | Film Amount (g/m²) | Adhesive Properties | Corrosion Resistance | Chromium Elution (μg/m²) | Inter-Layer Resistance (Ω-cm²/one layer) | Heat Resistance | Punchability (× 10⁴ times) | Weldability (cm/min) |
| Examples | A1 | 0.46 | ○ | ◎ | Lower 200 | 63 | ○ | 150~200 | ○ |
| | 2 | 1.00 | ○ | ○ | Lower 200 | 80 | ○ | 150~200 | ○ |
| | 3 | 0.95 | ○ | ○ | Lower 200 | 65 | ○ | 150~200 | Δ |
| | 4 | 0.64 | ○ | ○ | Lower 200 | 70 | ○ | >100 | ○ |
| | 5 | 1.83 | ○ | ◎ | 300 | 96 | ○ | >200 | Δ |
| | 6 | 0.95 | ○ | ○ | Lower 200 | 78 | ○ | >200 | ○ |
| | 7 | 1.32 | ○ | ○ | Lower 200 | 96 | ○ | 50~100 | ○ |
| | 8 | 1.02 | ○ | ◎ | Lower 200 | 83 | ○ | 100~150 | ○ |
| | 9 | 0.96 | ○ | ○ | Lower 200 | 73 | ○ | >100 | ○ |
| Comparison Examples | A1 | 0.83 | Δ | Δ~X | 1200 | 85 | ○ | >200 | ○ |
| | 2 | 0.90 | ○ | Δ | Lower 200 | 35 | ○ | 100~150 | Δ |
| | 3 | 1.00 | Δ | ○ | Lower 200 | 80 | ○ | >200 | X |
| | 4 | 1.05 | ○ | X | Lower 200 | 15 | ○ | 100~150 | X~Δ |
| | 5 | 0.95 | ○ | X | Lower 200 | 40 | X~Δ | <80 | ○ |

Note 1 Weight % of the unvolatile matter or the PAN dispersion with respect to the combined unvolatile matters in the mixed resinous liquid, expressed in terms of [PAN] × 100 [PAN] × 100 or [PAN] × 100 [AE] + [PAN], [AS] + [PAN], [AE] + [PAN]
Note 2 Weight parts with respect to 100 weight parts of the chromate calculated as $CrO_3$.

From Table 1, it is appreciated that, in accordance with the method of the present invention, foaming during coating is suppressed by containing a certain or higher amount of PAN in the film-forming composition and, as a result, all the film-forming compositions containing PAN show excellent coating properties.

The obtained films are sufficiently satisfactory as the insulating films for electromagnetic steel plates in view of the various properties, and provide insulating films which could not be obtained in the prior art.

Referring particularly to Example A1, the inter-layer resistance is as high as 63 Ω-cm² per plate and the punchability exceeds the characteristic value of 1,500,000 times, in spite of the fact that the film amount is as small as 0.46 g/m². Referring to Example A5, the punchability is excellent, as expressed in terms of the characteristic value of 2,000,000 times or higher, although the film amount is as high as 1.83 g/m$^2$. In this Example A5 and Examples A3, the weldability is slightly low, but offer no practical problem.

Referring on the other hand to Comparison Example A1 that is an example of the film-forming composition in which only PAN is substantially contained as the organic component, no problem arises in connection with the properties of the composition itself, but problems arise in connection with the adhesive properties, corrosion resistance and chromium elution of the film obtainable therefrom. Thus, that composition cannot be used. In Comparison Example A2 which contains the PAN unvolatile matter but in which its proportion in weight % with respect to the combined unvolatile matters of the mixed resinous liquid is lower than the lower limit defined in the present invention and Comparison Example A4 in which any PAN unvolatile matter is not contained at all, both the film-forming compositions are poor in the foamability and coating properties, and so cannot be used, since the properties of the resulting films are unsatisfactory. In Comparison Examples A3 and A4 in which, whilst the mixed resinous liquid has the composition within the range defined in the present invention, the proportion of the combined unvolatile matters with respect to the amount of the chromate calculated as $CrO_3$ exceeds and is within the upper and lower limits defined in the present invention, no substantial problem arises in connection with the properties of the compositions at the stage at which they are used to form films. However, both compositions of Comparison Examples A3 and A5 cannot be used, since the former offers a problem in connection with weldability due to the fact that the proportion of the organic component with respect to the inorganic component is large in the resulting film, and the latter offers a problem in connection with punchability due to the fact that such a proportion is small.

EXAMPLES B1-9 AND COMPARISON EXAMPLES B1 to 5

The procedures of Examples A were repeated except that the already exemplified Concrete Examples 3 and 4 were used as the aqueous solutions of the inorganic film-formable substances containing the chromate and phosphate as the main components.

The obtained results are set forth in Table 2 in which AE, AS AND PAN have the same meanings as in Table 1.

TABLE 2

| | | Composition of Insulating Film-Forming Composition | | | | | | Estimation of Properties | | |
|---|---|---|---|---|---|---|---|---|---|---|
| | | Inorganic Film-Forming Composition | Composition of Mixed Resinous Liquid | | | | Combined Unvolatile Matter of Mixed Resinous Liquid (weight parts)Note 2 | Properties of Composition | | |
| | | | [AE] | [AS] | [PAN] | Weight % of [PAN] Note 1 | | Foamability | Storage Stability | Coating Properties |
| Examples | B1 | (Concrete Example 1) | 3 | — | 15 | 83 | 120 | ◎ | No Change | ○ |
| | 2 | (Concrete Example 1) | — | 3 | 15 | 83 | 75 | ◎ | No Change | ○ |
| | 3 | (Concrete Example 1) | — | 1 | 2 | 67 | 75 | ○ | No Change | ○ |
| | 4 | (Concrete Example 1) | — | 1 | 2 | 67 | 75 | ○ | No Change | ○ |
| | 5 | (Concrete Example 2) | — | 1 | 2 | 67 | 75 | ○ | No Change | ○ |
| | 6 | (Concrete Example 2) | 2 | 1 | 8 | 73 | 75 | ○ | No Change | ○ |
| | 7 | (Concrete Example 2) | 15 | — | 3 | 17 | 120 | ○ | No Change | ○ |
| | 8 | (Concrete Example 2) | 1 | 1 | 10 | 83 | 80 | ◎ | No Change | ○ |
| | 9 | (Concrete Example 2) | 1 | — | 2 | 67 | 20 | ◎ | No Change | ○ |
| Comparison Examples | B1 | (Concrete Example 1) | — | — | 15 | 100 | 100 | ◎ | No Change | ○ |
| | 2 | (Concrete Example 1) | 10 | — | 0.8 | 7 | 75 | X | No Change | X |
| | 3 | (Concrete Example 1) | 5 | — | 10 | 66 | 133 | ○ | No Change | ○ |
| | 4 | (Concrete Example 2) | 2 | 1 | — | 0 | 100 | X | No Change | X |
| | 5 | (Concrete Example 2) | 1 | — | 1 | 50 | 13 | ○ | No Change | Δ |

| | | Estimation of Properties Film Properties | | | | | | | |
|---|---|---|---|---|---|---|---|---|---|
| | | Film Amount (g/m$^2$) | Adhesive Properties | Corrosion Resistance | Chromium Elution (μg/m$^2$) | Inter-Layer Resistance (Ω-cm$^2$/one layer) | Heat Resistance | Punchability (× 10$^4$ times) | Weldability (cm/min) |
| Examples | B1 | 1.00 | ○ | ○ | Lower 150 | 78 | ○ | 150~200 | ○ |
| | 2 | 0.95 | ○ | ○ | Lower 150 | 75 | ○ | 100~150 | ○ |
| | 3 | 0.52 | ○ | ○ | Lower 150 | 55 | ○ | 100~150 | ○ |
| | 4 | 1.05 | ○ | ○ | Lower 150 | 85 | ○ | 100~150 | ○ |
| | 5 | 1.90 | ○ | ◎ | Lower 150 | 195 | ○ | 150~200 | Δ |

TABLE 2-continued

| | | | | | | | | | |
|---|---|---|---|---|---|---|---|---|---|
| | 6 | 1.65 | O | ◎ | Lower 150 | 98 | O | 150~200 | O |
| | 7 | 0.65 | O | O | Lower 150 | 60 | O | 150~200 | O |
| | 8 | 0.86 | O | O | Lower 150 | 70 | O | 100~150 | O |
| | 9 | 1.35 | O | ◎ | Lower 150 | 75 | O | 50~100 | O |
| Comparison Examples | B1 | 0.75 | Δ | Δ~X | 800 | 74 | O | 150~200 | O |
| | 2 | 0.86 | O | Δ | Lower 150 | 48 | O | 100~150 | O |
| | 3 | 0.98 | Δ | O | Lower 150 | 81 | O | 150~200 | X |
| | 4 | 0.95 | O | O | Lower 150 | 35 | O | 100~150 | X |
| | 5 | 1.00 | O | X | Lower 150 | 35 | Δ | 50~80 | O |

Note 1 Weight % of the unvolatile matter or the PAN dispersion with respect to the combined unvolatile matters in the mixed resinous liquid, expressed in terms of [PAN] × 100 [PAN] × 100 or [PAN] × 100 [AE] + [PAN] (AS) + [PAN], [AE] + [AS] + [PAN]
Note 2 Weight parts with respect to 100 weight parts of the chromate and phosphate, calculated as $CrO_3$ and $H_3PO_4$.

From Table 2, it is appreciated that, in accordance with the method of the present invention, foaming during coating is suppressed by containing a certain or higher amount of PAN in the film-forming compostion and, as a result, all the film-forming compositions containing PAN show excellent coating properties.

The obtained films are sufficiently satisfactory as the insulating films for electromagnetic steel plates in view of the various properties, and provide insulating films which could not be obtained in the prior art.

The compositions of Examples B1 and B7 excel in punchability in particular, as expressed in terms of as high as 1,500,000 to 2,000,000 times, and show satisfactory weldability, since the weight percentage of the combined unvolatile matters of the mixed resinous liquids is large, i.e., the proportion of the organic component is high. The composition of Example B5, in which the largest film amount is found, is somewhat poor is weldability but excels in other properties. The composition of Example B9 excels in weldability, since the weight percentage of the combined unvolatile matters of the mixed resin liquid is small, i.e., the proportion of the organic component is low. However, that composition is somewhat poor in punchability, but offers no practical problem.

Referring on the other hand to Comparison Example B1 that is an example of the film-forming composition in which only PAN is substantially contained as the organic component, no problem arises in connection with the properties of the composition itself, but problems arise in connection with the adhesive properties, corrosion resistance and chromium elution of the film obtainable therefrom. Thus, that composition cannot be used. In Comparison Example B2 which contains the PAN unvolatile matter but in which it proportion in weight % with respect to the combined unvolatile matters of the mixed resinous liquid is lower than the lower limit defined in the present invention and Comparison Example B4 in which any PAN unvolatile matter is not contained at all, both film-forming compositions are poor in the foamability and coating properties, and so cannot be used, since the properties of the resulting films are unsatisfactory. In Comparison Examples B3 and B5 in which, whilst the mixed resinous liquid has the composition within the range defined in the present invention, the proportion of the combined unvolatile matters with respect to the amount of the chromate and phosphate calculated as $CrO_3$ and $H_3PO_4$ exceeds and is within the upper and lower limits defined in the present invention, no substantial problem arises in conection with the properties of the compositions at the stage at which they are used to form films. However, both the compositions of Comparison Examples B3 and B5 cannot be used, since the former offers a problem in connection with weldability due to the fact that the proportion of the organic component with respect to the inorganic component is large in the resulting film, and the latter offers problems in connection with punchability due to the fact that such a proportion is small and corrosion and heat resistance.

From the results of the examples and comparison examples, it is found that the film-forming compositions according to the present invention have a longer pot life, are capable of being foamed and excel in coating properties, and that they can form films which satisfy many properties needed as the insulating films for electromagnetic steel plates.

What is claimed is:

1. A composition for forming an insulating film on an electromagnetic steel plate, which comprises:

a mixed resinous liquid obtained by mixing an aqueous emulsion of pH 2 to 8, in which an organic film-formable resin consisting of at least one member selected from the group consisting of acrylic resins and acryl-styrene base resins is emulsified and dispersed, with an aqueous dispersion of pH 6 to 8, in which an acrylonitrile base resin is dispersed and which is substantially free from any emulsifier/dispersant, in such a manner that unvolatile matter in the aqueous dispersion amounts to 10 to 90% by weight of the combined amount of unvolatile manner in the aqueous dispersion and the aqueous emulsion, and an aqueous solution of an inorganic film-formable substance containing a chromate as the main component added to and mixed with the thus obtained mixed resinous liquid in such a manner that unvolatile matter in said mixed resinous liquid amounts to 15 to 120 parts by weight with respect to 100 parts by weight of said chromate in said aqueous solution, calculated as $CrO_3$, thereby obtaining a composition for forming an insulating film on an electromagnetic steel plate.

2. A composition as recited in claim 1, in which said inorganic film-forming composition containing a chromate as the main component is an aqueous solution based on $CrO_2$—ZnO—$H_3BO_3$—glycerin, $CrO_2$—M-gO—$H_3BO_3$—glycerin or $CrO_2$—CaO—$H_3BO_3$—glycerin.

3. A method for forming an insulating film on an electromagnetic steel plate, which comprises:

mixing an aqueous emulsion of pH 2 to 8, in which an organic film-formable resin consisting of at least one member selected from the group consisting of acrylic resins and acryl-styrene base resins is emulsified and dispersed, with an aqueous dispersion of pH 6 to 8, in which an acrylonitrile base resin is dispersed and which is substantially free from any emulsifier/dispersant, in such a manner that unvolatile matter in the aqueous dispersion amounts to 10 to 90% by weight of the combined amount of unvolatile matter in the aqueous dispersion and the aqueous emulsion, thereby obtaining a mixed resinous liquid, adding and mixing the thus obtained mixed resinous liquid to and with an aqueous solution of an inorganic film-formable substance containing a chromate as the main component in such a manner that unvolatile matter in said mixed resinous liquid amounts to 15 to 120 parts by weight with respect to 100 parts by weight of said chromate in said aqueous solution, calculated as $CrO_3$, thereby obtaining a composition for forming an insulating film on an electromagnetic steel plate, and coating the thus obtained composition on an electromagnetic steel plate followed by heating at 300° to 500° C., thereby forming an insulating film in the range of 0.4 to 2.0 g/m$^2$.

4. A composition for forming an insulating film on an electromagnetic steel plate, comprising:

a mixed resinous liquid obtained by mixing an aqueous emulsion of pH 2 to 8, in which an organic film-formable resin consisting of at least one member selected from group consisting of acrylic resins and acryl-styrene base resins is emulsified and dispersed, with an aqueous dispersion of pH 6 to 8, in which an acrylonitrile base resin is dispersed and which is substantially free from any emulsifier/dispersant, in such a manner that unvolatile matter in the aqueous dispersion amounts to 10 to 90% by weight of the combined amount of unvolatile matter in the aqueous dispersion and the aqueous emulsion, and an aqueous solution of an inorganic film-formable substance containing a chromate and a phosphate as the main components thereof, the ratio of the amount of chromate, calculated as $CrO_3$, to the amount of phosphate, calculated as $H_3PO_4$, being from 2:1 to 1:1, added to and mixed with the thus obtained mixed resinous liquid in such a manner that unvolatile matter in said mixed resinous liquid amounts to 15 to 120 parts by weight with respect to 100 parts by weight of said chromate and said phosphate in said aqueous solution, calculated as $CrO_3$ and $H_3PO_4$, thereby obtaining a composition for forming an insulating film on an electromagnetic steel plate.

5. A method for forming an insulating film on an electromagnetic steel plate, which comprises:

mixing an aqueous emulsion of pH 2 to 8, in which an organic film-formable resin consisting of at least one member selected from the group consisting of acrylic resins and acryl-styrene base resins is emulsified and dispersed, with an aqueous dispersion of pH 6 to 8, in which an acrylonitrile base resin is dispersed and which is substantially free from any emulsifier/dispersant, in such a manner that unvolatile matter in the aqueous dispersion amounts to 10 to 90% by weight of the combined amount of unvolatile matter in the aqueous dispersion and the aqueous emulsion, thereby obtaining a mixed resinous liquid, adding and mixing the thus obtained mixed resinous liquid to and with an aqueous solution of an inorganic film-formable substance containing a chromate and a phosphate as the main components thereof, the ratio of the amount of said chromate, calculated as $CrO_3$, to the amount of said phosphate, calculated as $H_3PO_4$, being from 2:1 to 1:1, in such a manner that unvolatile matter in said mixed resinous liquid amounts to 15 to 120 parts by weight with respect to 100 parts by weight of said chromate and said phosphate in said aqueous solution, calculated as $CrO_3$ and $H_3PO_4$, thereby obtaining a composition for forming an insulating film on an electromagnetic steel plate, and coating the thus obtained composition on an electromagnetic steel plate followed by heating at 300° to 500° C., thereby forming an insulating film in the range of 0.4 to 2.0 g/m$^2$.

* * * * *